US007401904B2

(12) United States Patent
Sekiguchi

(10) Patent No.: US 7,401,904 B2
(45) Date of Patent: Jul. 22, 2008

(54) INK JET HEAD AND METHOD OF MANUFACTURING THE INK JET HEAD

(75) Inventor: Yasuhiro Sekiguchi, Nagoya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 333 days.

(21) Appl. No.: 11/133,872

(22) Filed: May 20, 2005

(65) Prior Publication Data

US 2005/0259136 A1 Nov. 24, 2005

(30) Foreign Application Priority Data

May 20, 2004 (JP) ..... 2004-150231

(51) Int. Cl.
*B41J 2/045* (2006.01)

(52) U.S. Cl. ..... 347/68; 347/5; 347/9; 347/19; 347/71; 29/25.35

(58) Field of Classification Search ..... 347/68–72, 347/5, 9, 19; 29/25.35
See application file for complete search history.

(56) References Cited

U.S. PATENT DOCUMENTS 4,704,675 A * 11/1987 Jacobs et al. ..... 347/14
5,402,159 A 3/1995 Takahashi et al.
5,757,392 A * 5/1998 Zhang ..... 347/14
6,036,297 A * 3/2000 Hayasaki ..... 347/13
6,796,631 B2 9/2004 Kojima
6,984,010 B2 * 1/2006 Hosono et al. ..... 347/19
2003/0063449 A1 4/2003 Suzuki et al.

* cited by examiner

*Primary Examiner*—Manish S. Shah
*Assistant Examiner*—Mark J Stevenosky, Jr.
(74) *Attorney, Agent, or Firm*—Reed Smith LLP

(57) ABSTRACT

An ink jet head is manufactured by joining together a cavity unit and an actuator unit. The cavity unit has a plurality of nozzles and a plurality of pressure chambers. The actuator unit has a plurality of piezoelectric elements. The cavity unit is joined to the actuator unit such that each of the piezoelectric elements is located to face a corresponding pressure chamber. A method of manufacturing the ink jet head includes a step of defining a relation between an average nozzle diameter of a cavity unit and an average capacitance of an actuator unit. The method also includes a step of measuring the average nozzle diameter of each of cavity units and a step of measuring the average capacitance of each of actuator units. A matching cavity unit and actuator unit are selected to satisfy the relation defined in the defining step, and the selected cavity unit and the selected actuator unit are joined together.

8 Claims, 6 Drawing Sheets

INK JET HEAD AND METHOD OF MANUFACTURING THE INK JET HEAD

CROSS-REFERENCE TO RELATED APPLICATION

This application claims priority to Japanese Patent Application No. 2004-150231 filed on May 20, 2004, the contents of which are hereby incorporated by reference into the present application.

BACKGROUND OF THE INVENTION

1. Field of the Invention

The present invention relates to a method of manufacturing an ink jet head used within an ink jet printer. The present invention also relates to the ink jet head itself.

2. Description of the Related Art

A known technique for manufacturing an ink jet head is to join together a cavity unit and an actuator unit. The cavity unit has a plurality of nozzles and a plurality of pressure chambers. Each of the pressure chambers joins with a corresponding one of the nozzles. The actuator unit comprises a plurality of piezoelectric elements. When the cavity unit and the actuator unit are joined together, each piezoelectric element is located to face a corresponding one of the pressure chambers. Deformation of the piezoelectric elements applies pressure to ink filling the pressure chambers.

At the time of a printing operation, the piezoelectric elements are selected in accordance with the pattern of printing desired. Voltage is applied to the selected piezoelectric elements. The piezoelectric elements that have voltage applied thereto deform due to piezoelectric effects. When the piezoelectric element deforms, there is a contraction in capacity of its corresponding pressure chamber, pressure is thus applied to the ink filling the pressure chamber, and the ink is discharged from the nozzle connecting with the pressure chamber.

In order to obtain satisfactory printing, it is important to control the ejection speed of the ink being discharged from the nozzle such that this speed is constant. If the ejection speed is too fast or too slow, it is consequently not possible to obtain satisfactory printing.

It is known that there are various causes of fluctuation in the ejection speed of the ink. When the present inventors were researching the causes for such fluctuation, they learnt that large fluctuations were caused by: nozzle diameter, capacitance of the piezoelectric element in the vicinity of the pressure chamber that connects with the nozzle, and the voltage applied to the piezoelectric element. That is: the greater the nozzle diameter, the slower the ink ejection speed; the greater the capacitance of the piezoelectric element, the faster the ink ejection speed; and the greater the voltage applied to the piezoelectric element, the faster the ink ejection speed.

Since the nozzle diameter of the cavity unit is extremely small, it is difficult to process all the nozzles such that they have a uniform diameter.

Numerous nozzles are present in the cavity unit, and consequently there is variation in nozzle diameter even within the same cavity unit. The printer manufacturer produces the cavity units in quantity, and consequently there is also variation in nozzle diameter between one cavity unit and the next. In this latter case, the average nozzle diameter of the nozzles within the cavity unit varies from one cavity unit to the next.

Improved processing techniques have made it possible to reduce the degree of variation in nozzle diameter within the same cavity unit. By contrast, it is difficult to reduce the variation whereby the average nozzle diameter of the nozzles within one cavity unit varies the average nozzle diameter within other cavity units.

Further, the actuator unit is usually manufactured by making a plurality of folds in an extremely thin sheet. Since the piezoelectric elements within the actuator unit are formed from the same sheets, there is a small degree of variation in the capacitance of the piezoelectric elements within the same actuator unit. By contrast, it is difficult to reduce the variation whereby the average capacitance of the piezoelectric elements within one actuator unit varies the average capacitance in other actuator units. It is difficult to reliably control the thickness of the extremely thin sheets. Therefore, it is assumed that the variation in capacitance is caused by the variation in the thickness of the sheets of each actuator unit.

As described above, there is a degree of variation that cannot be tolerated between the average nozzle diameter of nozzles within one cavity unit and that in other cavity units. Similarly, there is a degree of variation that cannot be tolerated between the average capacitance of the piezoelectric elements within one actuator unit and that in other actuator units.

Due to this variation between units, there is a variation that cannot be tolerated in the ejection speed of the ink discharged from differing ink jet heads each made by joining together a cavity unit and an actuator unit. As described earlier, each ink jet head comprises a plurality of nozzles. Improved processing techniques have made it possible to reduce the degree of variation in the ink ejection speed between the nozzles in the same ink jet head. However, it is extremely difficult to reduce the variation of the average ink ejection speed between ink jet heads.

The present applicants have succeeded in reducing the variation of the average ink ejection speed between ink jet heads. This was done by adopting the following technique (Japanese Patent Application Publication No. 2003-11376; U.S. Pat. No. 6,796,631). The present applicants disclosed a relational expression that uses the average nozzle diameter of the nozzles within the cavity unit and the average capacitance of the piezoelectric elements within the actuator unit. This relational expression is used to calculate the voltage required to realize a determined average ink ejection speed when the cavity unit and the actuator unit have been joined together. When this relational expression is used, it is possible to determine the voltage to be applied to the ink jet head that has been formed by joining together these units. This is achieved by measuring the average nozzle diameter of the nozzles within the cavity unit, and the average capacitance of the piezoelectric elements within the actuator unit. When the voltage that has been determined in this manner is applied, the average ink ejection speed of the nozzles in the ink jet head is adjusted so as to be constant. Below, for the sake of simplicity, the average ink ejection speed of the nozzles within the ink jet head will be referred to as average ejection speed. The average nozzle diameter of the nozzles within the ink jet head will be referred to as average nozzle diameter. The average capacitance of the piezoelectric elements within the ink jet head will be referred to as average capacitance.

BRIEF SUMMARY OF THE INVENTION

Usually, a power supply for applying voltage to an ink jet head is mounted on a printer main body side. In the prior method described above, a different voltage must be applied to each ink jet head. Furthermore, the voltage to be applied to the ink jet head mounted in the printer main body is not known until it is determined which ink jet head will be mounted. It is consequently necessary to provide the printer main body with a power supply in which the voltage can be adjusted. This creates the problem that the configuration of a power supply circuit becomes more complicated.

The present invention has been created to solve the above problem, and aims to present a technique in which a stable ink ejection speed can be realized, and in which it is possible to simplify the configuration of a power supply for applying voltage to an ink jet head.

There is great variation in the average ejection speed of differing ink jet heads obtained by the random joining together of a cavity unit and an actuator unit. The present inventors discovered that the variation in the average ejection speed can be reduced when the ink jet heads are obtained by joining together a cavity unit and an actuator unit in a precise manner.

That is, when an actuator unit having a large average capacitance is joined with a cavity unit having a large average nozzle diameter, an actuator unit having a fast average ejection speed is joined with a cavity unit having a slow average ejection speed. This cancels out the influence of the variation between the two. Alternatively, when an actuator unit having a small average capacitance is joined with a cavity unit having a small average nozzle diameter, an actuator unit having a slow average ejection speed is joined with a cavity unit having a fast average ejection speed. This cancels out the influence of the variation between the two. By joining the cavity unit and the actuator unit in this precise manner, variation in the average ejection speed of differing ink jet heads can be reduced.

The present inventors discovered that if there is a constant relation between the average nozzle diameter of the nozzles of the cavity unit and the average capacitance of the piezoelectric elements of the actuator unit, the average ejection speed of the ink jet heads is constant even without adjusting the voltage applied to the actuator units. They discovered that if a combination of a cavity unit and an actuator unit is determined such that their average nozzle diameter and average capacitance respectively fulfill this relation, and the cavity unit and the actuator unit combined with the cavity unit are assembled, a constant average ejection speed can be obtained. There is no need to adjust the voltage applied to the ink jet heads. Using the ink jet heads obtained in this manner allows the power supply of the ink jet printer to have a simpler configuration.

BRIEF DESCRIPTION OF THE DRAWINGS

FIG. 6(*b*) shows how average ejection speed of ink is influenced by changes in average nozzle diameter of the cavity unit.

DETAILED DESCRIPTION OF THE PREFERRED EMBODIMENT

Figure 1:
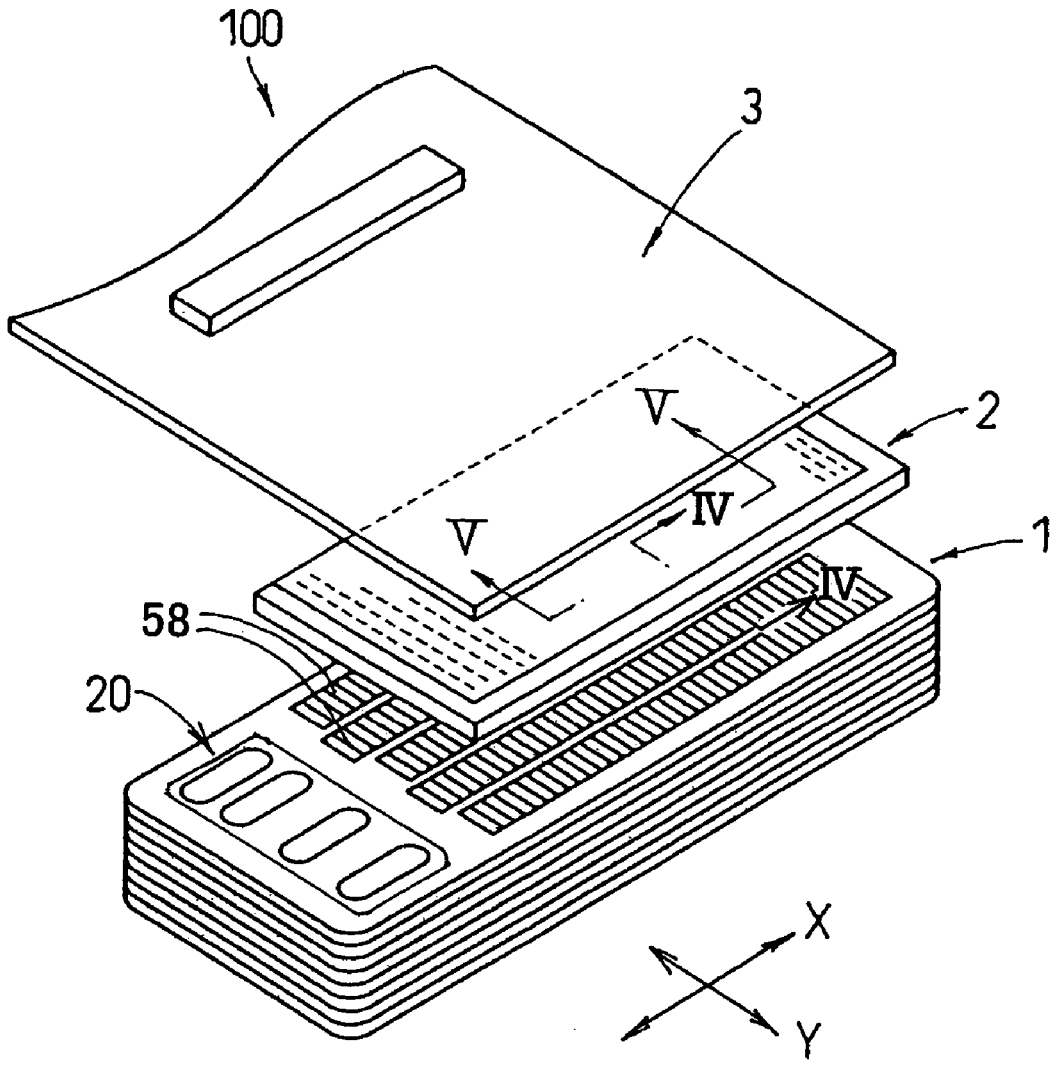
FIG. 1 shows a perspective view of an ink jet head of the present embodiment.

The present invention uses the information that it is possible to adjust the average ejection speed of the ink jet heads by means of selecting which cavity units and actuator units will be joined together. By applying this information, it is possible to mass-produce ink jet heads which have little variation in their average ejection speed. However, the present invention is not restricted to this use. The present invention can be applied so as to manufacture ink jet heads having a fast average ejection speed, and can be applied so as to manufacture ink jet heads having a slow average ejection speed. An actuator unit having a large average capacitance can be joined with a cavity unit having a small average nozzle diameter to manufacture an ink jet head having a fast average ejection speed. An actuator unit having a small average capacitance can be joined with a cavity unit having a large average nozzle diameter to manufacture an ink jet head having a slow average ejection speed.

In the present technique, the relation between the average nozzle diameter of the cavity unit and the average capacitance of the actuator unit is determined in advance. This relation is determined on the basis of the average ejection speed desired. In the case of mass producing ink jet heads having a small degree of variation in the average ejection speed from one ink jet head to the next, the relation is used whereby an actuator unit having a large average capacitance is joined with a cavity unit having a large average nozzle diameter. In the case of mass producing ink jet heads having a fast average ejection speed, the relation is used whereby an actuator unit having a large average capacitance is joined with a cavity unit having a small average nozzle diameter. In the case of mass producing ink jet heads having a slow average ejection speed, the relation is used whereby an actuator unit having a small average capacitance is joined with a cavity unit having a large average nozzle diameter.

Various methods can be used to measure the average nozzle diameter. For example, all the nozzle diameters in one cavity unit may be measured, and the average thereof calculated to obtain the average nozzle diameter. Alternatively, some nozzles can be selected randomly, and their average diameter can be calculated to obtain the average nozzle diameter. Further, in the case where there is little variation in the nozzle diameter of nozzles within the cavity unit, it is possible to measure the diameter of only one nozzle and to determine this diameter to be the average nozzle diameter. Alternatively, pressure applied to the ink can be held constant, and the average nozzle diameter can be calculated from the quantity of ink discharged at this time. The aforementioned average nozzle diameter can be expressed by various parameters that can be converted to average nozzle diameter. For example, the sum of the nozzle diameters is equivalent to average nozzle diameter.

Furthermore, various methods can also be used to measure the average capacitance. For example, the capacitance of all the piezoelectric elements in one actuator unit may be measured, and the average thereof calculated to obtain the average capacitance. Alternatively, some piezoelectric elements can be selected randomly, and their average capacitance can be calculated to obtain the average capacitance. Further, in the case where there is little variation in the capacitance of the piezoelectric elements in the actuator unit, it is possible to measure the capacitance of one piezoelectric element and to determine this capacitance to be the average capacitance. The total capacitance of all the piezoelectric elements in one actuator unit may be measured. The aforementioned average capacitance can be expressed by various parameters that can be converted to average capacitance. For example, the sum of capacitance of all the piezoelectric elements is equivalent to average capacitance. Further, since there is a relation between the capacitance of the piezoelectric element and the thickness of this piezoelectric element, the average thickness of each piezoelectric element can be used instead of its average capacitance.

Moreover, 'voltage applied to the actuator unit' refers to the voltage difference between applying voltage to the actuator unit and not applying voltage thereto, and does not refer to a constant application of voltage to the actuator unit.

A preferred embodiment of the present technique will now be described with reference to the drawings. FIG. 1 shows an exploded perspective view of a piezoelectric ink jet head 100 of the present embodiment. The ink jet head 100 performs printing on paper or the like by discharging ink from a plurality of nozzles (not shown in FIG. 1) located at its lower face. The ink jet head 100 is mounted on a member termed a carriage (not shown) capable of moving in a direction (an X direction) orthogonal to a delivery direction of the paper (a Y direction). The paper to be printed is delivered in the Y direction, and movement of the carriage in the X direction allows the entire range of the paper to be printed. Cyan, magenta, yellow, and black ink cartridges are directly or indirectly connected with the ink jet head 100.

The ink jet head 100 comprises a cavity unit 1, an actuator unit 2, a flat cable 3, etc. The cavity unit 1 is formed from a plurality of metal plates. A detailed description of the configuration of the cavity unit 1 will be given later. The actuator unit 2 connects with an upper face of the cavity unit 1. The actuator unit 2 is formed from a plurality of piezoelectric sheets. A detailed description of the configuration of the actuator unit 2 will be given later. The flat cable 3 connects with an upper face of the actuator unit 2. Electric power from a printer main body is supplied to the actuator unit 2 via the flat cable 3.

Figure 2:
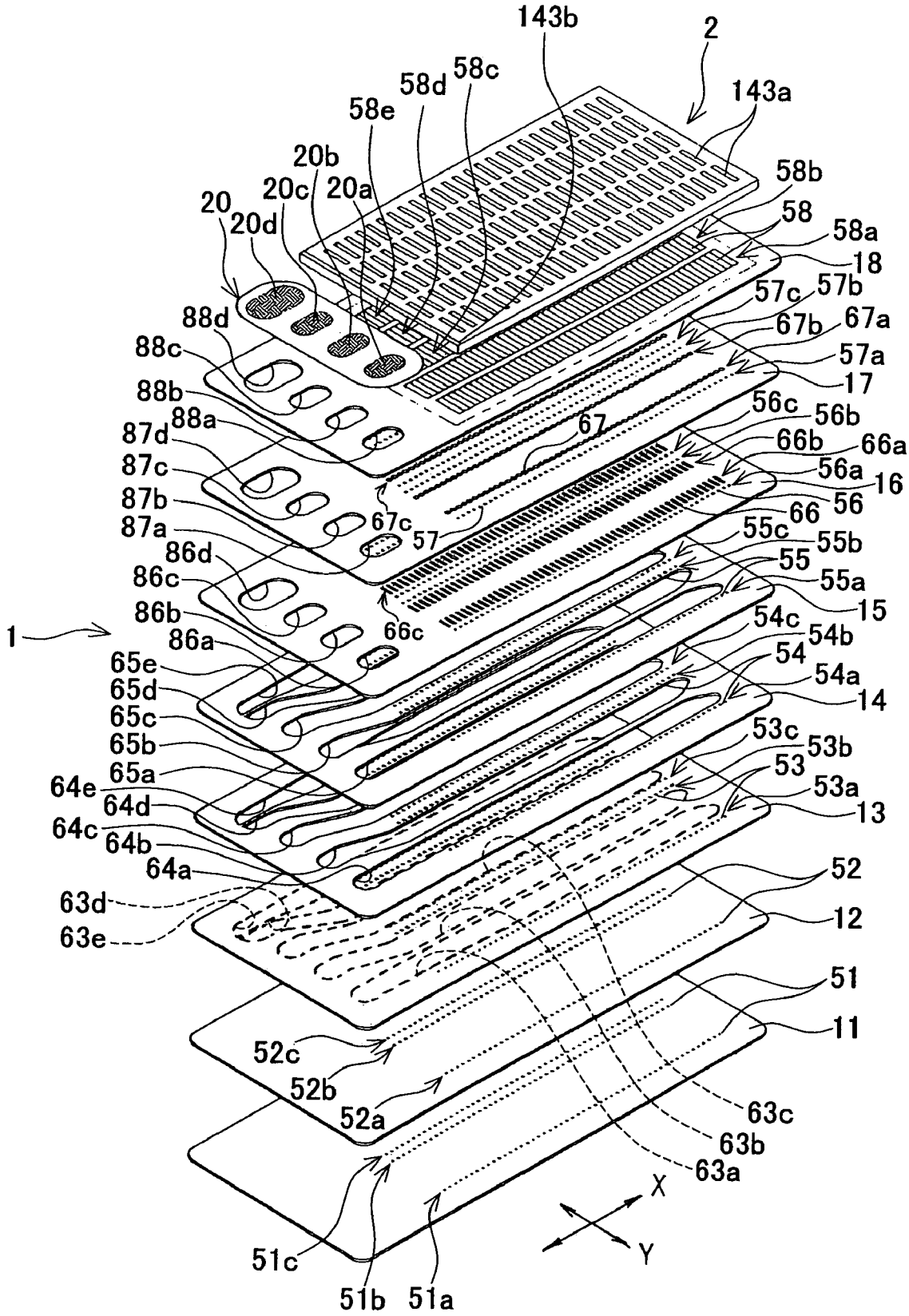
FIG. 2 shows an exploded perspective view of a cavity unit.
Figure 3:
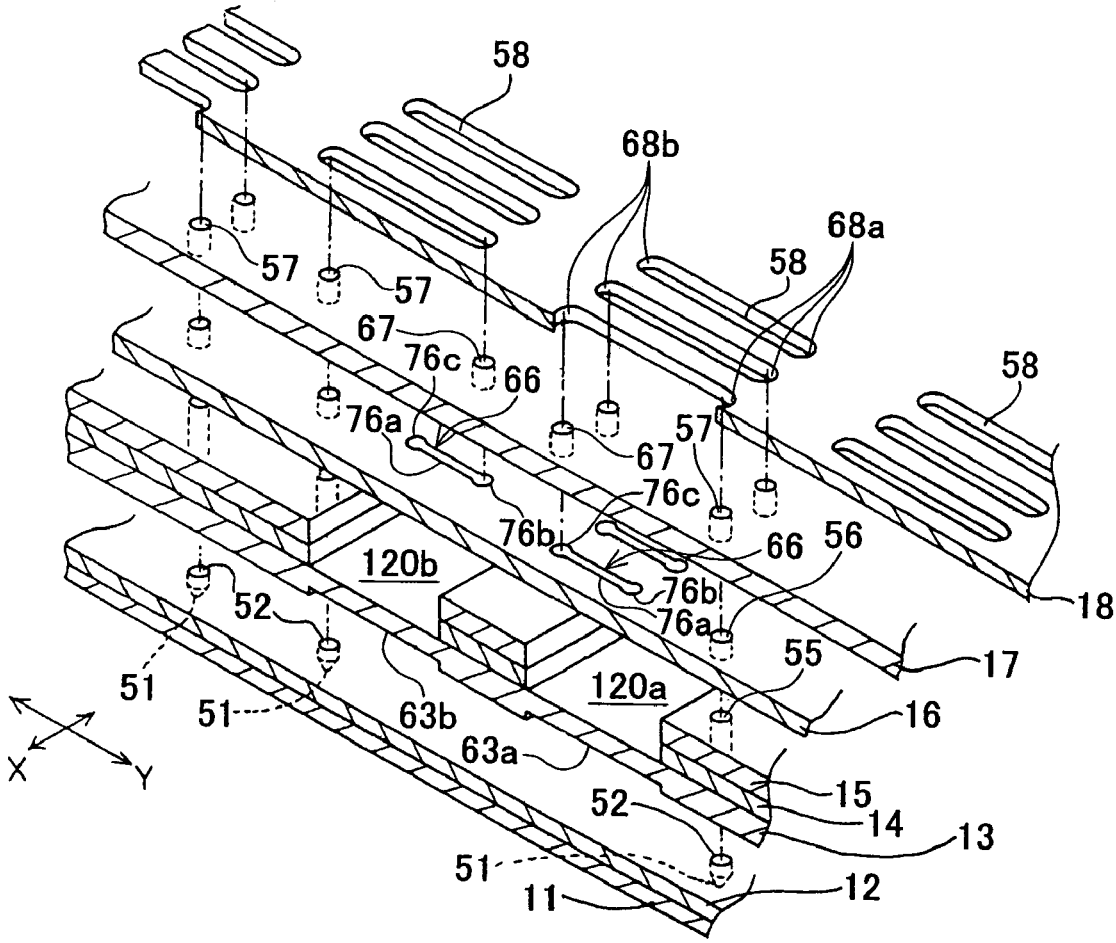
FIG. 3 shows a partially expanded exploded perspective view of the cavity unit.
Figure 4:
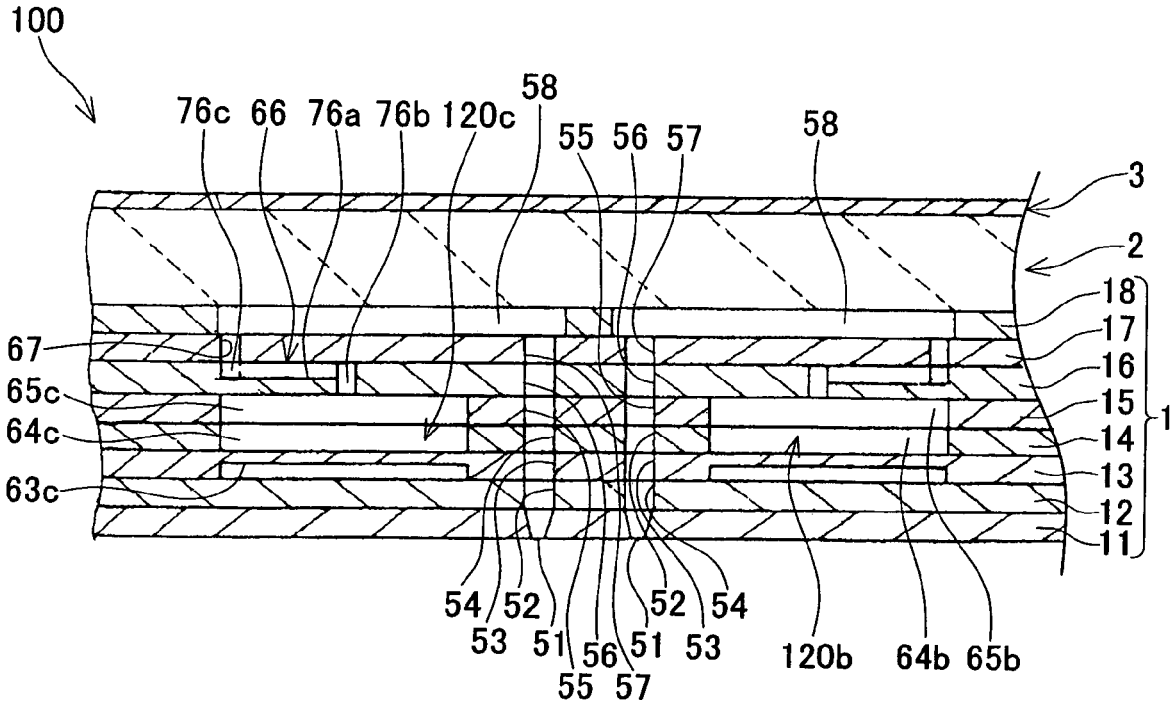
FIG. 4 is a cross-sectional view along the line IV-IV of FIG. 1.
Figure 5:
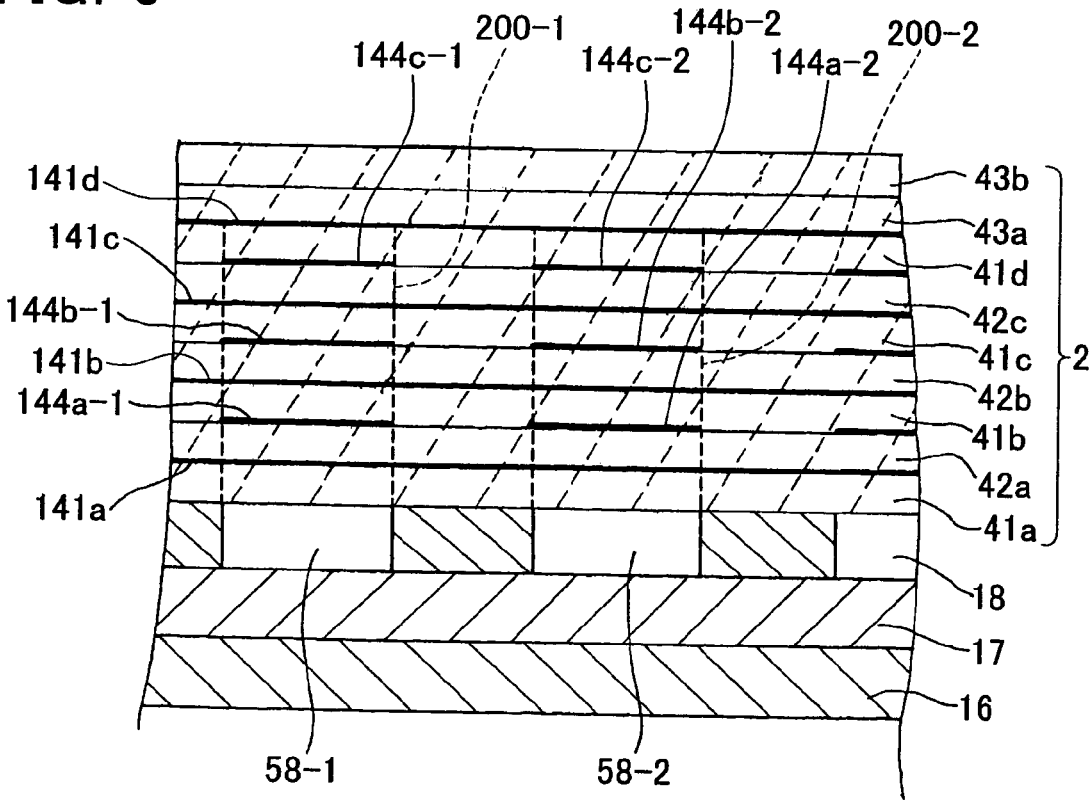
FIG. 5 is a cross-sectional view along the line V-V of FIG. 1.

Next, a detailed description of the configuration of the cavity unit 1 will be given with reference to FIGS. 2 to 5. FIG. 2 is an exploded perspective view of the cavity unit 1. Further, FIG. 2 also shows the actuator unit 2 connected with the upper face of the cavity unit 1. FIG. 3 shows a partially expanded exploded perspective view of the cavity unit 1. FIG. 4 is a cross-sectional view along the line IV-IV of FIG. 1, and FIG. 5 is a cross-sectional view along the line V-V of FIG. 1.

As is clear from FIG. 2, the cavity unit 1 comprises eight thin plates bonded together by adhesive. These comprise, in sequence from below, a nozzle plate 11, a spacer plate 12, a damper plate 13, a first manifold plate 14, a second manifold plate 15, a supply plate 16, a base plate 17, and a cavity plate 18. In the present embodiment, each of the plates 11 to 18 has a thickness of approximately 50 to 150 (μm). The nozzle plate 11 is formed from synthetic resin such as polyimide, etc. The remaining plates 12 to 18 are formed from 42% nickel alloy steel plate.

The nozzle plate 11 has rows of nozzles 51*a*, 51*b*, and 51*c* formed from nozzles 51 that have an extremely small diameter (approximately 20 to 23 (μm)) and are aligned in the X direction. In FIG. 2, a reference number has not been applied to all the nozzles 51. However, each of the small points shown on an upper side of the nozzle plate 11 is a nozzle 51. As is clear from FIGS. 3 and 4, the nozzles 51 are holes that pass through the nozzle plate 11 in its direction of thickness. The nozzles 51 grow smaller in diameter towards their lower side.

Moreover, only the rows of nozzles 51*a*, 51*b*, and 51*c* are shown in FIG. 2. However, the nozzle plate 11 actually has five rows of nozzles. Although this is not shown, a row of nozzles adjacent to the row of nozzles 51*c*—this being opposite the row of nozzles 51*b*—is represented by the number 51*d*, and a row of nozzles adjacent to the row of nozzles 51*d* is represented by the number 51*e*. The rows of nozzles 51*a* to 51*e* are parallel in the Y direction. A relatively large space is formed between the row of nozzles 51*a* and the row of nozzles 51*b*. By contrast, there is a small space between the rows of nozzles 51*b* and 51*c*. There is again a large space between the rows of nozzles 51*c* and 51*d*, and there is a small space between the rows of nozzles 51*d* and 51*e*.

The spacer plate 12 is connected with an upper face of the nozzle plate 11. As shown in FIG. 2, the spacer plate 12 has rows of spacer plate holes (referred to hereafter as SP holes) 52*a*, 52*b*, and 52*c* formed from SP holes 52 that have an extremely small diameter (approximately 20 to 23 (μm)) and are aligned in the X direction. In FIG. 2, a reference number has not been applied to all the SP holes 52. However, each of the small points shown on an upper side of the spacer plate 12 is an SP hole 52. As is clear from FIGS. 3 and 4, the SP holes 52 are holes that pass through the spacer plate 12 in its direction of thickness. The diameter of the SP holes 52 is constant along this direction of thickness, and this diameter is identical with the diameter of an upper end of the nozzles 51.

Moreover, only the row of SP holes 52*a*, 52*b*, and 52*c* are shown in FIG. 2. However, the spacer plate 12 actually has five rows of SP holes. Although this is not shown, a row of SP holes adjacent to the row of SP holes 52*c*—this being opposite the row of SP holes 52*b*—is represented by the number 52*d*, and a row of SP holes adjacent to the row of SP holes 52*d* is represented by the number 52*e*. The rows of SP holes 52*a* to 52*e* are parallel in the Y direction.

In the case where the spacer plate 12 is overlapped with the nozzle plate 11, the nozzles 51 and the SP holes 52 are in a uniform location.

The damper plate 13 is connected with an upper face of the spacer plate 12. As shown in FIG. 2, the damper plate 13 has rows of damper plate holes (referred to hereafter as DP holes) 53*a*, 53*b*, 53*c*, 53*d*, and 53*e* aligned in the X direction (in FIG. 2, a reference number has not been applied to the rows of DP holes 53*d* and 53*e*). These rows of DP holes 53*a* to 53*e* are formed from DP holes 53 with an extremely small diameter. In FIG. 2, a reference number has not been applied to all the DP holes 53. However, each of the small points shown on an upper side of the damper plate 13 is a DP hole 53. As is clear from FIGS. 3 and 4, the DP holes 53 are holes that pass through the damper plate 13 in its direction of thickness. The diameter of the DP holes 53 is constant along this direction of thickness, and this diameter is identical with the diameter of the SP holes 52 (that is, with the diameter of the upper end of the nozzles 51).

In the case where the damper plate 13 is overlapped with the spacer plate 12, the DP holes 53 and the SP holes 52 are in a uniform location.

Five grooves 63*a*, 63*b*, 63*c*, 63*d*, and 63*e*, each having a base, are formed in a lower face of the damper plate 13 (see FIG. 2). Each of the grooves 63*a* to 63*e* extends in the X direction. The grooves 63*a* to 63*e* are mutually parallel in the Y direction. Each of the grooves 63*a* to 63*e* has a constant depth. The grooves 63*a* and 63*b* are formed between the rows of DP holes 53*a* and 53*b*. The grooves 63*c* and 63*d* are formed between the rows of DP holes 53*c* and 53*d*. The groove 63*e* is located in the vicinity of the row of DP holes 53*e*. The damper plate 13 in the locations with the grooves 63*a* to 63*e* is thin. This allows the damper plate 13 to bend upwards or downwards more easily. Pressure applied to an ink chamber (to be described) can thus be absorbed, and the operation of the damper can thus be realized.

The first manifold plate 14 is connected with an upper face of the damper plate 13. As shown in FIG. 2, the first manifold plate 14 has rows of first manifold plate holes (referred to hereafter as first MP holes) 54*a*, 54*b*, 54*c*, 54*d*, and 54*e* formed from first MP holes 54 that have an extremely small diameter and are aligned in the X direction (in FIG. 2, a reference number has not been applied to 54*d* and 54*e*). In FIG. 2, a reference number has not been applied to all the first MP holes 54. However, each of the small points shown on the first manifold plate 14 is a first MP hole 54. As is clear from FIGS. 3 and 4, the first MP holes 54 are holes that pass through the first manifold plate 14 in its direction of thickness. The diameter of the first MP holes 54 is constant along this direction of thickness, and is identical with the diameter of the DP holes 53 (that is, with the diameter of the upper end of the nozzles 51).

In the case where the first manifold plate 14 is overlapped with the damper plate 13, the first MP holes 54 and the DP holes 53 are in a uniform location.

Further, five long holes 64*a*, 64*b*, 64*c*, 64*d*, and 64*e* are formed in the first manifold plate 14 (see FIG. 2). Each of the long holes 64*a* to 64*e* extends in the X direction. The long holes 64*a* to 64*e* are mutually parallel in the Y direction. The long holes 64*a* to 64*e* pass through the first manifold plate 14 in its direction of thickness. The shape of the long hole 64*a* in the XY direction is identical with the shape of the groove 63*a* of the damper plate 13 in the XY direction. Similarly, the shape of the long holes 63*b* to 64*e* in the XY direction is identical with the shape of the grooves 63*b* to 63*e* of the damper plate 13 in the XY direction. When the first manifold plate 14 is overlapped with the damper plate 13, the grooves 63*a* to 63*e* of the damper plate 13 and the long holes 64*a* to 64*e* of the first manifold plate 14 are in a uniform location.

The second manifold plate 15 is connected with an upper face of the first manifold plate 14. The second manifold plate 15 has a shape identical with that of the first manifold plate 14. That is, the second manifold plate 15 has rows of second manifold plate holes (referred to hereafter as second MP holes) 55*a* to 55*e* (in FIG. 2, a reference number has not been applied to 55*d* and 55*e*), and has five long holes 65*a* to 65*e*. Since the configuration of the first manifold plate 14 has been described in detail, a detailed description of the second manifold plate 15 will be omitted.

As is clear from FIG. 4, when the first manifold plate 14 and the second manifold plate 15 are connected, the long holes 64*a* to 64*e* and the long holes 65*a* to 65*e* overlap to form five large cavities 120*a*, 120*b*, 120*c*, 120*d*, and 120*e* (in FIG. 4, only the two cavities 120*b* and 120*c* are shown). That is, the cavity 120*a* (not shown) is formed from the long hole 64*a* and the long hole 65*a*. The cavity 120*b* is formed from the long hole 64*b* and the long hole 65*b*. The cavity 120*c* is formed from the long hole 64*c* and the long hole 65*c*. The cavity 120*d* (not shown) is formed from the long hole 64*d* and the long hole 65*d*, and the cavity 120*e* (not shown) is formed from the long hole 64*e* and the long hole 65*e*. These cavities 120*a* to 120*e* form chambers enclosed by the upper face of the damper plate 13 and a lower face of the supply plate 16 (described next). The chambers 120*a* to 120*e* function as ink chambers for storing the ink. Cyan ink is stored in the ink chamber 120*a*. Yellow ink is stored in the ink chamber 120*b*. Magenta ink is stored in the ink chamber 120*c*. Black ink is stored in the ink chamber 120*d* and the ink chamber 120*e*. The two ink chambers 120*d* and 120*e* are used for black ink because black ink is used more than ink of other colors.

The supply plate 16 is connected with an upper face of the second manifold plate 15. As is clear from FIG. 2, the supply plate 16 has rows of supply plate holes (referred to hereafter as SL holes) 56*a*, 56*b*, 56*c*, 56*d*, and 56*e* formed from SL holes 56 that have an extremely small diameter and are aligned in the X direction (in FIG. 2, a reference number has not been applied to 56*d* and 56*e*). In FIG. 2, a reference number has not been applied to all the SL holes 56. However, each of the small points shown on the supply plate 16 is an SL hole 56. As is clear from FIGS. 3 and 4, the SL holes 56 are holes that pass through the supply plate 16 in its direction of thickness. The diameter of the SL holes 56 is constant along this direction of thickness, and is identical with the diameter of the second MP holes 55 (that is, with the diameter of the upper end of the nozzles 51).

In the case where the supply plate 16 is overlapped with the second manifold plate 15, the SL holes 56 and the second MP holes 55 are in a uniform location.

Further, rows of SL long holes 66*a*, 66*b*, and 66*c*—these being formed from small long holes that are extending in the Y direction—are formed in the supply plate 16. Only the rows of SL long holes 66*a*, 66*b*, and 66*c* are shown in FIG. 2. However, the supply plate 16 actually has five rows of SL long holes. Although this is not shown, a row of SL long holes adjacent to the row of SL long holes 66*c* is represented by the number 66*d*. A row of SL long holes adjacent to the row of SL long holes 66*d* is represented by the number 66*e*. The SL long holes 66*a* to 66*e* are mutually parallel in the Y direction. One SL long hole 66 is provided for one SL hole 56. As a result, there are identical numbers of SL holes 56 and long holes 66. As shown in FIG. 4, each long hole 66 comprises: a groove 76*a* that is formed in the upper face of the supply plate 16 and extends in the Y direction; an intake hole 76*b* that connects with one end of the groove 76*a* and passes through the supply plate 16 in its direction of thickness; and a discharge hole 76*c* that connects with the other end of the groove 76*a*. As is clear from FIG. 3, the diameter of the intake hole 76*b* and the discharge hole 76*c* is greater than the width of the groove 76*a* when the supply plate 16 is viewed from the top. As shown in FIG. 4, the intake hole 76*b* of each long hole 66 is connected with an ink chamber (any one of 120*a* to 120*e*).

Furthermore, four ink supply holes 86*a*, 86*b*, 86*c*, and 86*d* are formed in the supply plate 16 (see FIG. 2). The ink supply holes 86*a*, 86*b*, 86*c*, and 86*d* are holes that pass through the supply plate 16 in its direction of thickness. The three ink supply holes 86*a*, 86*b*, and 86*c* have the same size. The ink supply hole 86*d* is somewhat larger than the other ink supply holes 86*a*, etc. The ink supply hole 86*a* connects with the ink chamber 120*a*. Similarly, the ink supply hole 86*b* connects with the ink chamber 120*b*, and the ink supply hole 86*c* connects with the ink chamber 120*c*. The ink supply hole 86*d* connects with the two ink chambers 120*d* and 120*e*.

The base plate 17 is connected with the upper face of the supply plate 16. As shown in FIG. 2, the base plate 17 has rows of first base plate holes 57*a*, 57*b*, 57*c*, 57*d*, and 57*e* (referred to hereafter as rows of first BP holes) formed from holes 57 that have an extremely small diameter (approximately 20 to 23 (μm)) and are aligned in the X direction (in FIG. 2, a reference number has not been applied to 57*d* and 57*e*). As is clear from FIGS. 3 and 4, the first BP holes 57 are holes that pass through the base plate 17 in its direction of thickness. The diameter of the first BP holes 57 is constant along this direction of thickness, and is identical with the diameter of the SL holes 56 (that is, with the diameter of the upper end of the nozzles 51). The rows of BP holes 57*a* to 57*e* are mutually parallel in the Y direction.

In the case where the base plate 17 is overlapped with the supply plate 16, the first BP holes 57 and the SL holes 56 are in a uniform location.

Further, the base plate 17 has rows of second base plate holes 67*a*, 67*b*, and 67*c* (referred to hereafter as rows of second BP holes) that are formed from a plurality of holes 67 aligned in the X direction. Only three rows of second BP holes 67*a*, 67*b*, and 67*c* are shown in FIG. 2. However, the base plate 17 actually has five rows of second BP holes. Although this is not shown, a row of second BP holes adjacent to the row of second BP holes 67*c*—this being opposite the row of second BP holes 67*b*—is represented by the number 67*d*. A row of second BP holes adjacent to the row of second BP holes 67*d* is represented by the number 67*e*. As is clear from FIGS. 3 and 4, the second BP holes 67 are holes that pass through the base plate 17 in its direction of thickness. The rows of second BP holes 67*a* to 67*e* are mutually parallel in the Y direction. One second BP hole 67 is provided for one first BP hole 57. As a result, there are identical numbers of first BP holes 57 and second BP holes 67.

In the case where the base plate 17 is overlapped with the supply plate 16, the second BP holes 67, and the discharge holes 76*c* of the long holes 66 are in a uniform location (see FIG. 3).

Further, the base plate 17 has four ink supply holes 87*a*, 87*b*, 87*c*, and 87*d*. The ink supply holes 87*a*, 87*b*, 87*c*, and 87*d* pass through the base plate 17 in its direction of thickness. The three ink supply holes 87*a*, 87*b*, and 87*c* have the same size. The ink supply hole 87*d* is somewhat larger than the other ink supply holes 87*a*, etc. The ink supply hole 87*a* joins with the ink supply hole 86*a* of the supply plate 16. Similarly, the ink supply hole 87*b* joins with the ink supply hole 86*b*, the ink supply hole 87*c* joins with the ink supply hole 86*c*, and the ink supply hole 87*d* joins with the ink supply hole 86*d*.

The cavity plate 18 is connected with an upper face of the base plate 17. As shown in FIG. 2, the cavity plate 18 has rows of long holes 58*a*, 58*b*, 58*c*, 58*d*, and 58*e*, these rows being formed from a plurality of long holes 58 aligned in the X direction. Each of long holes 58 extends in the Y direction. As is clear from FIGS. 3 and 4, the long holes 58 are holes that pass through the cavity plate 18 in its direction of thickness.

As is clear from FIG. 3, in the case where the cavity plate 18 is overlapped with the base plate 17, an edge 68*a* of each long hole 58 and the first BP holes 57 are in a uniform location, and the other edge 68*b* of each long hole 58 and the second BP holes 67 are in a uniform location.

As shown in FIG. 4, the long holes 58 form chambers enclosed by the upper face of the base plate 17 and a lower face of the actuator unit 2. Each chamber 58 functions as a pressure chamber whose capacity changes as the actuator unit 2 operates.

Further, the cavity plate 18 has four ink supply holes 88*a*, 88*b*, 88*c*, and 88*d*. The ink supply holes 88*a*, 88*b*, 88*c*, and 88*d* pass through the cavity plate 18 in its direction of thickness. The three ink supply holes 88*a*, 88*b*, and 88*c* have the same size. The ink supply hole 88*d* is somewhat larger than the other ink supply holes 88*a*, etc. The ink supply hole 88*a* joins with the ink supply hole 87*a* of the base plate 17. Similarly, the ink supply hole 88*b* joins with the ink supply hole 87*b*, the ink supply hole 88*c* joins with the ink supply hole 87*c*, and the ink supply hole 88*d* joins with the ink supply hole 87*d*.

A filter body 20 is bonded, using adhesive or the like, to an upper face of the cavity plate 18 (see FIG. 2). Filter parts 20*a*, 20*b*, 20*c*, and 20*d* of the filter body 20 correspond respectively to the ink supply holes 88*a*, 88*b*, 88*c*, and 88*d*. A cyan ink cartridge (not shown) is connected with the filter part 20*a* of the filter body 20. By this means, the cyan ink is filled into the ink chamber 120*a* via the filter part 20*a*. Further, a yellow ink cartridge (not shown) is connected with the filter part 20*b*. A magenta ink cartridge (not shown) is connected with the filter part 20*c*, and a black ink cartridge (not shown) is connected with the filter part 20*d*.

Next, the configuration of the actuator unit 2 will be described with reference to FIG. 5. FIG. 5 is a cross-sectional view along the line V-V of FIG. 1. The actuator unit 2 is identical with a known version disclosed in Japanese Patent Application No. 1992-341853 (U.S. patent application Publication No. 5,402,159A). Consequently, only a simple description of the configuration of the actuator unit 2 will be given here. The actuator unit 2 has nine sheets 41*a*, 42*a*, 41*b*, 42*b*, 41*c*, 42*c*, 41*d*, 43*a*, and 43*b*. Each sheet 41*a*, etc. has a thickness of approximately 30 (μm).

The sheets 41*a*, 41*b*, 41*c*, and 41*d* are common electrode sheets, and common electrodes 141*a*, 141*b*, 141*c*, and 141*d* are provided on respective upper faces thereof.

The sheets 42*a*, 42*b*, and 42*c* are separate electrode sheets, and separate electrodes 144 are provided on respective upper faces thereof. The number 144 is not present in FIG. 5, whereas 144*a*-1, 144*b*-1, etc. are present. However, the number 144 is used to represent the entirety of the separate electrodes 144*a*. The separate electrode sheet 42*a* has a separate electrode 144*a* corresponding to each of the pressure chambers 58 of the cavity plate 18. That is, the separate electrode sheet 42*a* is provided with separate electrodes 144*a* corresponding to the number of pressure chambers 58 formed in the cavity plate 18. The separate electrode sheet 42*a* is provided with the separate electrodes 144 such that, when the cavity unit 1 and the actuator unit 2 have been joined together, the separate electrodes 144*a* of the separate electrode sheet 42*a* and each pressure chamber 58 of the cavity plate 18 are in a uniform location in the XY direction. The separate electrode sheets 42*b* and 42*c* have a configuration approximately identical to that of the separate electrode sheet 42*a*. That is, the separate electrode sheet 42*b* is provided with separate electrodes 144*b* corresponding to each pressure chamber 58 of the cavity plate 18. The separate electrode sheet 42*c* is provided with separate electrodes 144*c* corresponding to each pressure chamber 58 of the cavity plate 18.

The common electrode sheets 41*a*, 41*b*, 41*c*, and 41*d*, and the separate electrode sheets 42*a*, 42*b*, and 42*c* are stacked as follows: the common electrode sheet 41*a* is the lowest layer, and then 42*a*, 41*b*, 42*b*, 41*c*, 42*c*, and 41*d* are stacked sequentially. In this case, the separate electrodes 144*a* of the separate electrode sheet 42*a*, the separate electrodes 144*b* of the separate electrode sheet 42*b*, and the separate electrodes 144*c* of the separate electrode sheet 42*c* are located so as to be on the same location in the XY direction. FIG. 5 clearly shows how the separate electrodes 144*a*-1, 144*b*-1, and 144*c*-1 are located on the same location, and how the separate electrodes 144*a*-2, 144*b*-2, and 144*c*-2 are located on the same location. Furthermore, this also shows clearly how a pressure chamber 58-1 is located almost directly below the separate electrodes 144*a*-1, 144*b*-1, and 144*c*-1 and how a pressure chamber 58-2 is located almost directly below the separate electrodes 144*a*-2, 144*b*-2, and 144*c*-2.

A further two sheets 43*a* and 43*b* are stacked above the common electrode sheet 41*d*. Surface electrodes 143*a* (not shown in FIG. 5, but shown in FIG. 2) are formed on an upper face of the uppermost sheet 43*b*. The surface electrodes 143*a* are electrically connected with the separate electrodes 144*a*, 144*b*, and 144*c*. As is clear from FIG. 2, each surface electrodes 143*a* formed on the sheet 43*b* correspond to each pressure chambers 53 of the cavity plate 18. One surface electrode 143*a* is electrically connected with the three separate electrodes 144*a*, 144*b*, and 144*c* that are located on the same location in the XY direction. For example, the separate electrodes 144*a*-1, 144*b*-1, and 144*c*-1 are connected with the same surface electrode 143*a*. Further, the separate electrodes 144*a*-2, 144*b*-2, and 144*c*-2 are connected with the same surface electrode 143*a*.

Further, surface electrodes 143*b* (shown in FIG. 2) are formed on the sheet 43*b* and are electrically connected with the common electrodes 141*a*, 14 1*b*, 141*c*, and 141*d*.

Since the actuator unit 2 is configured in the above manner, when current is carried through each surface electrode 143*a*, piezoelectric effects cause deformation between the separate electrodes 144*a* to 144*c* which are connected with the surface electrode 143*a*, and the common electrodes 141*a* to 141*d*. For example, in the case where current is carried through the separate electrodes 144*a*-1, 144*b*-1, and 144*c*-1 of FIG. 5, a range 200-1 deforms. That is, the range 200-1 can be termed one piezoelectric element. Similarly, when current is carried through the separate electrodes 144*a*-2, 144*b*-2, and 144*c*-2, a range 200-2 deforms, and the range 200-2 can be termed one piezoelectric element. Consequently, it can be said that the number of piezoelectric elements 200 existing in the actuator unit 2 is the number of separate electrodes 144*a* formed on one separate electrode sheet 42*a*. Each of piezoelectric elements 200 corresponds to each of pressure chambers 58.

The flat cable 3 shown in FIG. 1 transmits electric power to the surface electrodes 143*a* and 143*b*. The flexible printed circuit board disclosed in Japanese Patent Application Publication No. 2003-80683 (U.S. patent application Publication No. 2003/0063449A1) may, for example, be used as the flat cable 3, and a detailed description thereof is omitted here. When the actuator unit 2 is being driven, electric power is transmitted via the flat cable 3 to the surface electrode 143*b*, and to any of the surface electrodes 143*a* selected depending on the content of printing. A detailed description is given below of the operations of the cavity unit 1 and the actuator unit 2 when electric power is transmitted.

Electric power is carried to any of the surface electrodes 143*a* in accordance with the content of the image to be printed by the printer. For example, in a case where power is transmitted to the surface electrode 143*a* corresponding to the separate electrodes 144*a*-1, 144*b*-1, and 144*c*-1 shown in FIG. 5, power is also carried to the common electrodes 141*a*, 141*b*, and 141*c*. In this case, the piezoelectric element 200-1 deforms so as to protrude downward. That is, piezoelectric effects cause deformation between: the common electrode 141*a* and the separate electrode 144*a*-1, the separate electrode 144*a*-1 and the common electrode 141*b*, the common electrode 141*b* and the separate electrode 144*b*-1, the separate electrode 144*b*-1 and the common electrode 141*c*, the common electrode 141*c* and the separate electrode 144*c*-1, and the separate electrode 144*c*-1 and the common electrode 144*d*. The capacity of the pressure chamber 58-1 consequently decreases, and internal pressure of the pressure chamber 58-1 increases. Conversely, when power is turned off, the capacity of the pressure chamber 58-1 changes from a small to a large state, and the internal pressure of the pressure chamber 58-1 decreases. The internal pressure of the pressure chamber 58-1 can be changed by turning ON or OFF the power that is carried to the surface electrode 143*a* corresponding to the separate electrodes 144*a*-1, etc. Changing the internal pressure of the pressure chamber 58-1 causes ink to flow towards the nozzle 51 from the ink chamber (any of 120*a* to 120*e*) joined with the pressure chamber 58-1. This state is shown in FIG. 4.

When, for example, the internal pressure is reduced of the pressure chamber 58 at the left in FIG. 4 (that is, when the voltage applied to the surface electrode 143*a*, this corresponding to the pressure chamber 58 at the left, is turned OFF from having been ON), the ink flows from the ink chamber 120*c*, via the intake hole 76*b*, the groove 76*a*, the discharge hole 76*c*, and the second BP hole 67, toward the pressure chamber 58 at the left. Ink is thus filled into the pressure chamber 58. If, immediately after this, the internal pressure is increased of the pressure chamber 58 (that is, when the voltage applied is turned ON from having been OFF), the ink flows from the ink chamber 120*c* towards the nozzle 51 via the first BP hole 57, the SL hole 56, the second MP hole 55, the first MP hole 54, the DP hole 53, and the SP hole 52. The ink of the ink chamber 120*c* is thus discharged from the nozzle 51. Ink can be discharged repeatedly from the nozzle 51 by repeating this operation.

Next is a description of a manufacturing method for an ink jet printer 100 of the present embodiment.

Figure 6:
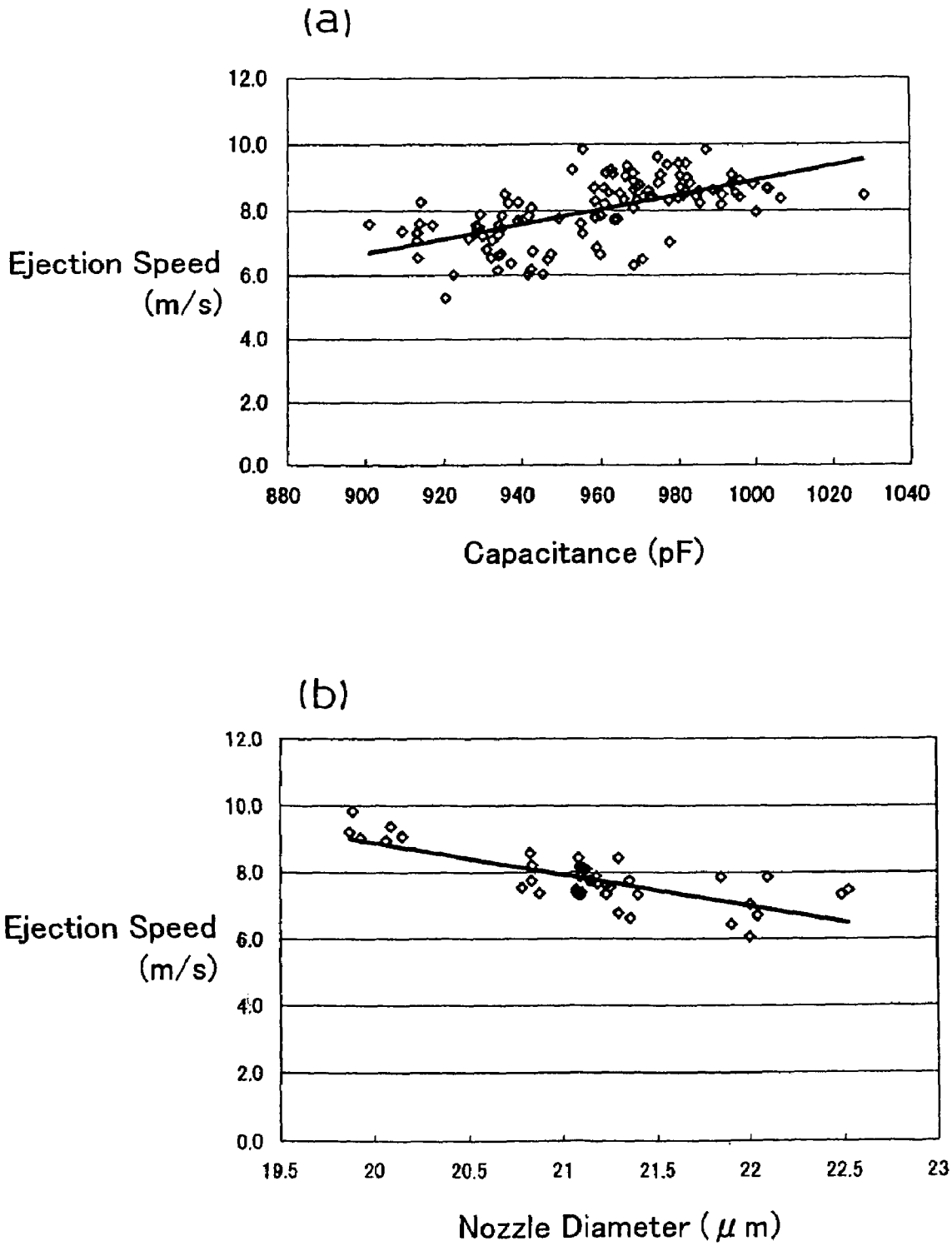
FIG. 6(*a*) shows how average ejection speed of ink is influenced by changes in average capacitance of an actuator unit.

(1) Step for Deriving a Relation Between Average Nozzle Diameter and Average Capacitance such that a Constant Ink Ejection Speed is Obtained when a Determined Voltage is Applied In order to obtain this relation, the present inventors provided several actuator units 2 in which the average capacitance differed of the piezoelectric elements 200, and joined each actuator unit 2 with a cavity unit 1. All the cavity units 1 had an identical average nozzle diameter. A determined voltage was then applied to the piezoelectric elements 200 of the actuator units 2, and the variation in ink ejection speed was examined. FIG. 6(*a*) shows the results of these experiments. FIG. 6.(*a*) plots the ejection speed of ink (actually, the average ejection speed) obtained when actuator units 2 having differing average capacitance (900 pF to 1030 pF in this experiment) were joined with cavity units 1 with a determined average nozzle diameter (21 (μm) in this experiment) and a constant voltage was applied.

Various methods can be used to measure the average nozzle diameter of the cavity units 1. For example, as disclosed in Japanese Patent Application Publication No. 2003-11376 (U.S. Pat. No. 6,796,631), picture processing may be performed to highlight the edges of a magnified image of each nozzle 51, and then the diameter of all the nozzles 51 may be measured and their average calculated. Alternatively, rather than measuring the nozzle diameter of all the nozzles 51, various nozzles 51 may be picked out, their diameter is measured, and the average is calculated. Alternatively, in the case where there is no great variation in the nozzle diameter of the nozzles 51 within one cavity unit 1, the diameter of one nozzle 51 may be measured, and this measurement may be used as the average nozzle diameter.

Furthermore, various methods can be used to measure the average capacitance. For example, as disclosed in Japanese Patent Application No. 2003-11376 (U.S. Pat. No. 6,796,631), voltage may be applied to each of the surface electrodes 143*a*, and the capacitance of each of the piezoelectric elements 200 may be measured separately to calculate the average capacitance. Alternatively, various surface electrodes 143*a* may be picked out, their capacitance is measured, and the average is calculated. Alternatively, in the case where there is no great variation in the capacitance of the piezoelectric elements 200 within one actuator unit 2, the capacitance of one piezoelectric element 200 may be measured, and this measurement may be used as the average capacitance. An impedance analyzer, for example, may be used to measure capacitance.

Furthermore, various methods can be used to measure the ink ejection speed. For example, as disclosed in Japanese Patent Application No. 2003-11376 (U.S. Pat. No. 6,796, 631), the ink ejection speed may be measured from the location of the ink before and after an extremely short time has elapsed. The ink ejection speed is the average of the ink discharged from each nozzle 51 in one cavity unit 1. In fact, the ink ejection speed of all the nozzles is measured, and their average is calculated.

It is clear from FIG. 6(*a*) that, in the case where the applied voltage and the average nozzle diameter are constant, the average ejection speed increases in proportion to the average capacitance.

The present inventors also examined how, in the case where the voltage applied is constant, and average capacitance is constant, the average ejection speed of the ink changes as the average nozzle diameter changes. FIG. 6(*b*) shows the results of these experiments. FIG. 6(*b*) plots the average ejection speed of the ink obtained when a constant voltage was applied and when a plurality of actuator units 2 having a determined average capacitance (960 pF in this experiment) were joined with cavity units 1 having differing average nozzle diameters (20 to 22.5 (μm) in this experiment).

The methods for measuring the average nozzle diameter, the average capacitance, and the ink ejection speed, are identical with those above, and a description thereof is omitted here.

It is clear from FIG. 6(*b*) that, in the case where the applied voltage and the average capacitance are constant, the average ejection speed increases as the nozzle diameter decreases.

To obtain an identical ink ejection speed when an identical voltage is applied, it is clear from the above results that it is preferred that an actuator unit 2 having a large average capacitance is joined with a cavity unit 1 having a large average nozzle diameter. Further, it is preferred that an actuator unit 2 having a small average capacitance is joined with a cavity unit 1 having a small average nozzle diameter. In the present embodiment, the slope of the graphs in FIGS. 6(*a*) and (*b*) (both of which have identical voltage) is used to find the relation between average nozzle diameter and average capacitance for obtaining a constant ink ejection speed in the case where a determined voltage is applied. Specifically, in the case where a determined voltage is applied and a constant ink ejection speed can be obtained, the rate of change is found for the average capacitance with respect to the average nozzle diameter. In the present embodiment, joining together a cavity unit 1 having an average nozzle diameter of 21 (μm) and an actuator unit 2 having an average capacitance of 960 pF was used as a standard, and a relation (below, this will be referred to as average nozzle diameter—average capacitance information) was used in accordance with the rate of change (20 pF/0.5 μm) from this standard. That is, an actuator unit 2 having an average capacitance of 980 pF is selected for a cavity unit 1 having an average nozzle diameter of 21.5 (μm), an actuator unit 2 having an average capacitance of 1000 pF is selected for a cavity unit 1 having an average nozzle diameter of 22.0 (μm), an actuator unit 2 having an average capacitance of 940 pF is selected for a cavity unit 1 having an average nozzle diameter of 20.5 (μm), and an actuator unit 2 having an average capacitance of 920 pF is selected for a cavity unit 1 having an average nozzle diameter of 20.0 (μm).

(2) Step for Manufacturing the Cavity Unit 1

The cavity unit 1 is manufactured by bonding the aforementioned sheets 11 to 18. The holes 51 to 58, 64 to 67, the grooves 63, etc. of the sheets are formed by etching, electrical discharge machining, plasma machining, laser machining, etc. The filter parts 20*a* to 20*d* are formed in the filter body 20 by laser machining, etc. The filter body 20 is formed from synthetic resin such as polyimide, or the like. In the case where the filter body 20 is formed from metal, the filter parts 20*a* to 20*d* may be formed by electroforming.

The bonding of the sheets 11 to 18 is performed as follows. First the following two sheets are bonded to manufacture a first sub-unit: the nozzle plate 11 and the spacer plate 12. Then the following six sheets are bonded to manufacture a second sub-unit: the damper plate 13, the first manifold plate 14, the second manifold plate 15, the supply plate 16, the base plate 17, and the cavity plate 18. Then the first and the second sub-units are bonded to manufacture the cavity unit 1.

(3) Step for Manufacturing the Actuator Unit 2

The actuator unit 2 is manufactured by bonding the aforementioned sheets 41*a* to 41*d*, 42*a* to 42*c*, 43*a*, and 43*d* (see FIG. 5). Ie manufacturing method of the sheets 41*a* to 41*d*, 42*a* to 42*c*, 43*a*, and 43*d* is known, and consequently a description thereof is omitted here.

(4) Step for Measuring the Average Nozzle Diameter of the Cavity Unit 1

The average nozzle diameter is measured for each of the cavity units 1 that has been manufactured. In the present embodiment, picture processing is performed to highlight the edges of a magnified image of each nozzle 51, and then the diameter of all the nozzles 51 is measured and their average is calculated. However, methods other than that used in the present embodiment may also be used to measure the average nozzle diameter. Since the other methods have been described above, a description thereof is omitted here.

(5) Step for of Measuring the Average Capacitance of the Actuator Unit 2

The average capacitance is measured for each of the actuator units 2 that have been manufactured. In the present embodiment, voltage is applied to each of the surface electrodes 143*a*, and the capacitance of each of the piezoelectric elements 200 is measured separately to measure the average capacitance. However, methods other than that used in the present embodiment may also be used to measure the average capacitance. Since the other methods have been described above, a description thereof is omitted here.

(6) Step for Matching the Cavity Unit 1 and the Actuator Unit 2

The average nozzle diameter of each cavity unit 1 and the average capacitance of each actuator unit 2 can be obtained by means of the above measuring processes. The matching of the cavity unit 1 and the actuator unit 2 is determined based on the average nozzle diameter—average capacitance information described above. That is, in the case of, for example, a cavity unit 1 having an average nozzle diameter of 21 (μm), it is determined that this cavity unit 1 should be matched with an actuator unit 2 having an average capacitance of 960 (pF). In another example, in the case of a cavity unit 1 having a nozzle diameter of 21.5 (μm), it is determined that this cavity unit 1 should be matched with an actuator unit 2 having an average capacitance of 980 (pF). In the case of, for example, a cavity unit 1 having a nozzle diameter of 20.0 (μm), it is determined that this cavity unit 1 should be matched with an actuator unit 2 having an average capacitance of 920 (pF).

(7) Step for Bonding the Cavity Unit 1 and the Actuator Unit 2 after Matching has been Determined The cavity unit 1 and the actuator unit 2 are bonded after being matched in the above process. An adhesive sheet (not shown) is used for this bonding. The adhesive sheet (not shown) consisting of a synthetic resin material that cannot be permeated by water is applied to the entirety of the lower face of the plate type actuator unit 2.

(8) Step for Connecting the Flexible Flat Cable 3 to the Actuator Unit 2

The flat cable 3 is caused to overlap with and is pressed onto the upper face of the actuator unit 2. Wiring patterns (not shown) of the flat cable 3 are electrically connected with the surface electrodes 143*a* and 143*b*.

Performing the aforementioned processes (1) to (8) completes the ink jet head 100.

Figure 7:
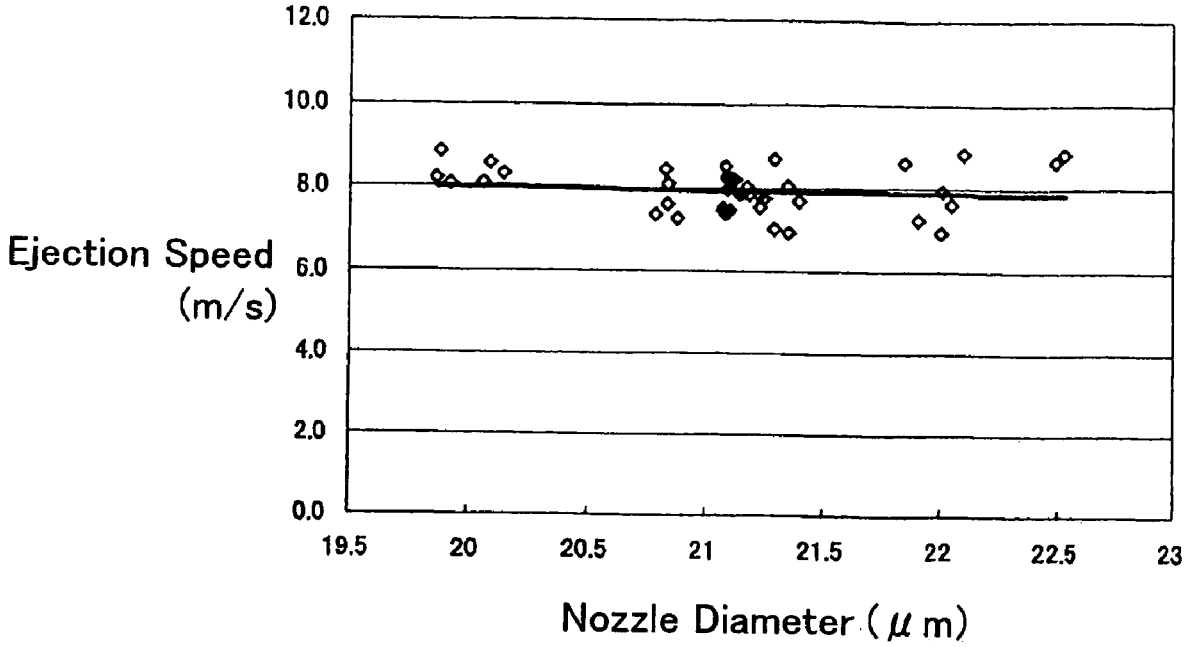
FIG. 7 shows the results concerning average nozzle diameter and average ejection speed of an ink jet head manufactured according to the present embodiment.

FIG. 7 shows test results for a plurality of the ink jet head 100 manufactured using the aforementioned processes. These test results concern ink ejection speed in the case where a determined voltage has been applied. In the graph of FIG. 7, the approximately straight line between the points has a slope of approximately zero. It is thus clear that ink ejection speed is approximately constant.

In the present embodiment, the matching of the cavity unit 1 and the actuator unit 2 is determined based on the average nozzle diameter—average capacitance information. Consequently, even if there is variation in the average nozzle diameter or average capacitance, it is easy to determine which cavity unit 1 and actuator unit 2 should be matched so as to obtain identical ink ejection speed by means of applying an identical voltage. By using the manufacturing method of the present embodiment, it is possible to obtain a constant ink ejection speed without changing the voltage applied. As a result, the power supply circuit for applying voltage to the ink jet head 100 needs to provide only one type of voltage, and it thus becomes a simple configuration.

In the above embodiment, the average nozzle diameter and average capacitance, and the rate of change of the average capacitance with respect to the average nozzle diameter, were used as standard 'average nozzle diameter—average capacitance information'. However, a table such as the following may also be used: a table defines a range of average capacitance related to a range of average nozzle diameter so as to maintain ink ejection speed within a specified range when a constant voltage is applied. For example, a range of 20.75 to 21.25 (μm) of average nozzle diameter is coupled to a range of 950 to 970 (pF) of average capacitance, and a range of 21.25 to 21.75 (μm) of average nozzle diameter is coupled to a range of 970 to 990 (pF) of average capacitance. The matching of the cavity unit 1 and the actuator unit 2 can be determined from the range of this table. Since there is a wide degree of freedom in selection, matching can be determined more easily.

With the ink jet head 100 manufactured in accordance with the present embodiment, identical ink ejection speed can be obtained by means of applying identical voltage, and consequently there is no need to vary the settings of the power supply for applying voltage for each ink jet head. As a result, the structure of the printer main body can be simplified. Furthermore, in the case of manufacturing a printer in which a plurality of ink jet heads is mounted, there is no need to select ink jet heads which require the same voltage. Manufacturing efficiency can thus be increased, and manufacturing costs can be decreased.

What is claimed is:

1. A method of manufacturing an ink jet head comprising a cavity unit and an actuator unit, the cavity unit comprising a plurality of nozzles and a plurality of pressure chambers, the actuator unit comprising a plurality of piezo electric elements, the cavity unit being joined with the actuator unit such that each piezoelectric element is located to face a corresponding pressure chamber, the method comprising:

a step of defining a relation between an average nozzle diameter of a cavity unit and an average capacitance of an actuator unit;

a step of measuring the average nozzle diameter of each of cavity units;

a step of measuring the average capacitance of each of actuator units;

a step of selecting a combination of one of the cavity units and one of the actuator units so that the average nozzle diameter of the selected cavity unit and the average capacitance of the selected actuator unit satisfy the relation defined in the defining step; and a step of joining together the selected cavity unit and the selected actuator unit, wherein there is no need to adjust voltage applied to the ink jet heads.

2. The method as defined in claim 1, wherein the relation between the average nozzle diameter of the cavity unit and the average capacitance of the actuator unit is defined such that, in the case where a predetermined voltage is applied to the piezoelectric elements of the actuator unit, an average ejection speed of ink discharged from the nozzles of the cavity unit joined to the actuator unit has a predetermined value.

3. The method as defined in claim 2, wherein a plurality of combinations of the average nozzle diameter of the cavity unit and the average capacitance of the actuator unit are defined in the defining step.

4. The method as defined in claim 3, wherein, in any of the combinations defined in the defining step, in the case where same voltage is applied to the piezoelectric elements of the actuator unit, an average ejection speed of ink discharged from the nozzles of cavity unit joined to the actuator unit has a constant value.

5. The method as defined in claim 1, wherein the relation between the average nozzle diameter of the cavity unit and the average capacitance of the actuator unit is defined such that a range of average capacitances corresponding to a range of average nozzle diameters is determined, and wherein in the case where a predetermined voltage is applied to the piezoelectric elements of the actuator unit having the range of average capacitances, an average ejection speed of ink discharged from the nozzles of the cavity unit having the range of average nozzle diameters and joined to the actuator unit falls within a predetermined range.

6. The method as defined in claim 5, wherein a plurality of combinations of the range of average nozzle diameters of the cavity unit and the range of average capacitances of the actuator unit are defined in the defining step.

7. The method as defined in claim 1, wherein the relation between the average nozzle diameter of the cavity unit and the average capacitance of the actuator unit is defined such that when the average nozzle diameter of the cavity unit is larger, the average capacitance of the actuator unit is also larger.

8. The method as defined in claim 7, wherein the relation between the average nozzle diameter of the cavity unit and the average capacitance of the actuator unit is defined according to a rate of change that when the average nozzle diameter of approximately 0.5μm increases, the average capacitance of approximately 20 pF also increases.

* * * * *